United States Patent [19]

Pierlot et al.

[11] 4,092,380

[45] May 30, 1978

[54] CARBURETORS FOR INTERNAL COMBUSTION ENGINES

[75] Inventors: Michel E. Pierlot, Le Pecq; Cyrille F. Pavlin, Septeuil, both of France

[73] Assignee: Societe Industrielle de Brevets et d'Etudes S.I.B.E., France

[21] Appl. No.: 806,095

[22] Filed: Jun. 13, 1977

[30] Foreign Application Priority Data

Jun. 17, 1976 France ..... 76 18406

[51] Int. Cl.[2] ..... F02M 7/20

[52] U.S. Cl. ..... 261/69 R; 123/119 R; 261/121 B

[58] Field of Search ..... 261/121 B, 69 R; 123/119 R

[56] References Cited

U.S. PATENT DOCUMENTS

| | | | |
|---|---|---|---|
| 3,009,794 | 11/1961 | Barfod | 261/69 R |
| 3,437,081 | 4/1969 | Mennesson | 261/69 R |
| 3,738,336 | 6/1973 | Holland | 261/DIG. 68 |
| 3,795,237 | 3/1974 | Denton | 261/121 B |
| 3,916,020 | 10/1975 | Malphettes et al. | 261/DIG. 67 |
| 4,046,118 | 9/1977 | Aono | 261/121 B |
| 4,053,543 | 10/1977 | Pettitt | 261/121 B |

FOREIGN PATENT DOCUMENTS

| | | | |
|---|---|---|---|
| 991,500 | 6/1951 | France | 261/69 R |

*Primary Examiner*—Tim R. Miles

*Attorney, Agent, or Firm*—Stevens, Davis, Miller & Mosher

[57] ABSTRACT

A carburetor for an internal combustion engine has a circuit for delivering a primary air/fuel mixture into the induction passage and means for correcting the richness of the airfuel mixture in dependence of the amplitude of the alternating component of the depression which prevails in operation in the induction passage. The correction device has a movable member which meters an air or fuel flow cross-sectional area in the circuit. The position of the movable member is controlled in dependence of the alternating component by a pressure sensitive diaphragm. A frequency filter connects the induction passage and chambers separated by the diaphragm for dampening the alternating component of the depression by an amount which increases with the frequency of that component.

6 Claims, 2 Drawing Figures

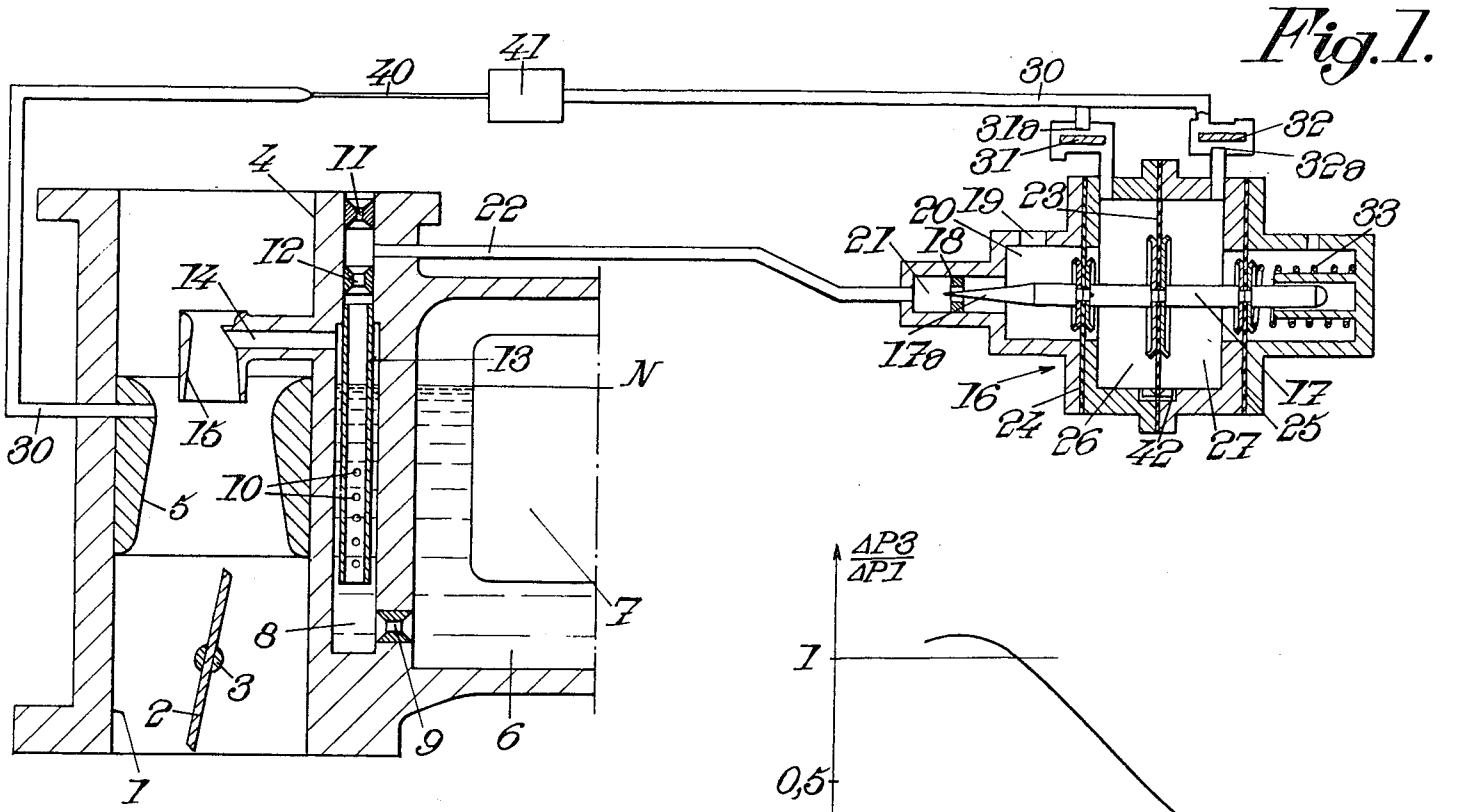
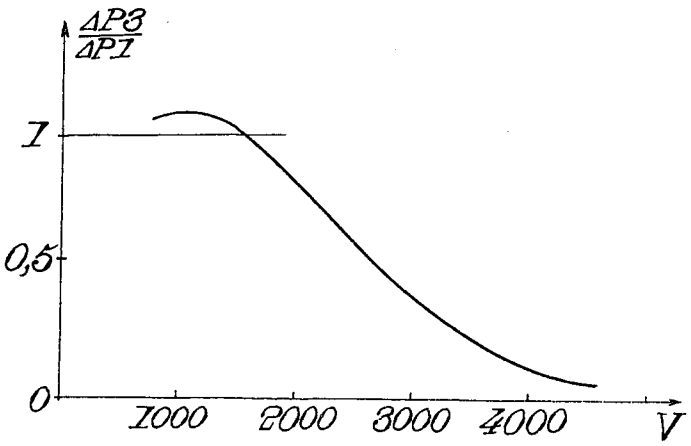
Fig.2.

CARBURETORS FOR INTERNAL COMBUSTION ENGINES

The invention relates to carburettors for internal combustion engines of the type having a device for correcting the richness of the air/fuel mixture supplied to the engine depending on the amplitude of the alternating pressure component caused, in the induction passage of the carburettor, by the pulsed nature of the aspiration of the cylinders of the engine in operation.

The intake of a piston internal combustion engine is subjected to pulsations operation due to the reciprocal movement of the pistons; the pulsations are particularly marked in modern engines in which the closing of the intake valves takes place with a considerable time delay; it is also very marked in engines having a small number of cylinders, as for example flat-twin engines; when such an engine is heavily loaded, the operator-operated throttle member of the carburettor, upstream of which is located the main fuel jet system, is fully open; the pulsated depression is applied to the fuel supply sustem and results in abnormal operation. In particular, when the engine runs at low speed, the air/fuel mixture supplied to the engine is too rich. The instability of the air flow, due to the pulsating character of the depression, may be such that a reversal of the air flow can be observed and spit back from the carburettor. Experience shows that, for the same amplitude of the depression fluctuation, the enrichment is reduced when the speed of the engine rises.

Different remedies have been proposed to combat this pulsating phenomenon. In French Pat. No. 2 206 784, there is described a carburettor in which the gas pressure above the fuel in the float-chamber is automatically adjusted by a device which connects the atmosphere of the float-chamber with the induction passage and which imposes on the air passing therethrough a pressure loss whose value changes according to the direction of flow.

This arrangement has favourable but generally insufficient effects, limited to low engine speeds.

It is an object of the present invention to provide a carburettor provided with a correction device which is easily adapted to different types of engines.

According to a first aspect of the invention, there is provided a carburettor for an internal combustion engine having an induction passage, a circuit for delivering a primary air/fuel mixture into said induction passage and a device for correcting the richness of the air/fuel mixture supplied by the carburettor in dependence of the amplitude of the alternating pressure component which prevails in operation in the induction passage, wherein said correction device has a member for metering a fuel or air flow cross-sectional area in said circuit and means for controlling said member in dependence of said alternating component, including a capillary tube and a capacity located in series flow relation from the induction passage for constituting a frequency filter and to transmit the depression which prevails in the induction passage with a dampening of the alternating component which increases with the frequency of that component.

The member typically limits a flow cross-section in a pipe supplying emulsion air to the main fuel jet system. This cross-section may be placed in parallel with a supplementary emulsion air supply restriction, permanently open.

The correction device may further comprise a main diaphragm separating two chambers and coupled to said flow cross-section adjusting member, said chambers being connected to the capacity by respective non-return valves, of low inertia, whose opening directions are opposed.

The invention will be better understood from the following description of a down-draught carburettor having a correction device and constituting a particular embodiment of the invention, given as an example only. The description refers to the accompanying drawings, in which:

FIG. 1 shows schematically, in cross-section, a carburettor whose throttle is wide open (which corresponds to the full load of the engine) whilst the valves of the correction device are in the intermediate position which they assume immediately after the depression in the intake passage has passed a maximum or minimum value, one of the valves being about to open and the other about to close; and FIG. 2 is a curve of the variation of the ratio between the amplitude of the alternating component applied to the adjusting member and the amplitude of the alternating component of pressure in the intake passage, as plotted against the rotational speed of the engine expressed in r.p.m.

The down-draught carburettor shown in FIG. 1 comprises an induction passage 1 having a throttle member 2 formed by a butterfly valve fixed on a spindle 3 controllable by an operator. The passage is provided with an air inlet 4 protected by an air-filter (not shown) and with a main venturi 5 into which opens a main air/fuel emulsion supply system, supplied with fuel from a float chamber 6. The float chamber 6 contains a float 7 controlling a fuel inlet needle (not shown) so as to maintain the free surface of the fuel approximately at level N.

The main supply system comprises: a well 8 supplied with fuel from float chamber 6 through a nozzle 9; a tube 13, formed in its lower part with perforations 10, dipping in well 8 to take fuel therefrom and mix it with emulsion air coming from air intake 4 of the carburettor, arriving through a channel provided with calibrated restrictions 11 and 12; and a channel 14 for flow of the air/fuel mixture from the upper part of well 8 into a secondary venturi 15 from where it emerges into the induction passage at the throat of the main venturi 5.

The carburettor is fitted with a richness correcting device 16 which adjusts the depression exerted on the main fuel supply system to correct for the variable amplitude of the alternating component of the depression which prevails in the induction passage; the correction device 16 comprises a metering member formed by a needle 17 movable inside a housing. The end part 17*a* of the needle, of continuously variable cross-section, cooperates with a calibrated aperture 18 for limiting a cross-sectional flow area which is added to that provided by the fixed restriction 11. A complementary air-flow is introduced into the fuel supply system of the carburettor, from the atmosphere, through successively an aperture 19 in the housing, a chamber 20 of the housing, the flow cross-section 17*a–18*, a chamber 21 and a channel 22 opening into the main supply system, between the air flow restrictors 11 and 12.

Needle 17 is connected to a main diaphragm 23 and two auxiliary diaphragms 24 and 25 located one on each side of the main diaphragm 23 and presenting a smaller effective area to the pressure. Diaphragms 23, 24 and 25 and the housing of corrector 16 define two work chambers 26 and 27 separated by diaphragm 23. The external faces of diaphragms 24 and 25 are subjected to atmospheric pressure. The work chambers, typically of the same volume, are connected to the same pipe 30 opening into the induction passage of the carburettor, at the throat of the main venturi 5, each through a non-return valve of low inertia 31 or 32. The valves have reversed operation; valve 31 associated with work chamber 26 (on the left of FIG. 1) tends to close under the effect of an increase of the depression in pipe 30, by bearing on a seat 31*a*, whereas valve 32 corresponding to work chamber 27 (on the right of FIG. 1) tends to open under the effect of the same increase of the depression, by moving away from a seat 32*a*; a decrease of the depression in pipe 30 has the opposite effects.

A spring 33 compressed between the housing of corrector 16 and one of two cups clamping auxiliary diaphragm 25, exerts on the mobile unit formed by the diaphragms and needle 17 an action which tends to decrease the air passage cross-section defined between the calibrated aperture 18 and end part 17*a* of needle 17 which projects thereinto.

Corrector 16, if connected directly to the intake pipe by a pipe 30 having a cross-section such that it transmits without any appreciable damping the variations of pressure, would operate in the following way.

Assuming that the engine is running under heavy load (FIG. 1), throttle valve 2 is widely open and a pulsed depression prevails in passage 1 and acts consequently on corrector 16 through pipe 30. The amplitude of the variation of the depression (the difference between the maximum value Dmax. and the minimum value Dmin.) will be referred to as $\Delta p$.

When the depression increases from its minimum value Dmin. to its maximum value Dmax., valve 32 opens (moving upward in FIG. 1). The depression in chamber 27 increases up to the maximum value Dmax.; if then the depression begins to decrease, valve 32 closes so that the unit comprising the chamber 27 and valve 32 constitutes a peak detector. On the other hand, valve 31, closed up till now, opens, by moving downwards in FIG. 1, and the depression in chamber 26 can decrease to the minimum value Dmin.: when the depression begins to increase again, valve 31 closes and so on; when a pulsed depression prevails, a difference of pressure between chambers 26 and 27 which is equal to $\Delta p =$ Dmax. − Dmin. is established in corrector 16; under the action of this pressure difference, diaphragm 23 will move rightwards (FIG. 1) against the force of spring 33 along with needle 17 and consequently increases the flow of air penetrating into the fuel supply system of the carburettor through channel 22: the depression exerted on the fuel in the supply system is thereby reduced and the air/fuel mixture supplied to the engine is rendered leaner in proportion to the increase in the amplitude of $\Delta p$ of the pressure pulses.

While the correction induced in this way depends on the amplitude $\Delta p$ of the pulses, it does not take into account the frequency of the pulsating phenomenon and, consequently, of the running speed of the engine.

In the embodiment of the invention illustrated in FIG. 1, a frequency filter is placed in pipe 30, between main venturi 5 and corrector 16. This filter comprises, in series relation, a capillary tube 40 of section *s* and length *l* and a capacity 41 of volume V. The frequency response of this filter, i.e. the law of variation of the ratio between the amplitudes of the alternating component $\Delta p_3$ in pipe 30, downstream of the filter, and of the alternating component of depression $\Delta p_1$ at the throat of the main venturi, as a function of the frequency of its pulses (and consequently of the speed of the engine) depends on the values of the parameters given to the filter, i.e. essentially on the value of *l*, *s* and V.

The parameters are typically chosen so as to obtain a response curve of the kind shown in FIG. 2. On FIG. 2, the ratio $\Delta p_3/\Delta p_1$ decreases rapidly as the speed of the engine increases, at least from speeds slightly higher than idling speed. In the illustrated embodiment, at a lower speed, the amplitude of the alternating component $\Delta p_3$ is not reduced in relation to $\Delta p_1$ and may even be slightly amplified. The correction device has therefore a maximum action on the richness. On the other hand, at high engine speeds, amplitude $\Delta p_3$ is very attenuated in relation to $\Delta p_1$ and the correction device has practically no action. In practice, it will generally be sufficient to provide a capillary tube 40 whose inner section will be of about 1 sq.mm. and whose length will be a few centimeters (generally 5 to 20 cm) followed by a capacity 41 whose volume will be substantially greater than that of work chambers 26 and 27. It will for example be from 50 to 100 cub.cm.

In the embodiment shown in FIG. 1, there is provided a port 42 of small cross-section, communicating work chambers 26 and 27. The role of port 42 is to rapidly balance the pressure in chambers 26 and 27 when the amplitude of the alternating component of the depression in the intake pipe diminishes substantially (for example following the closing of main throttle member 2) and so to rapidly eliminate the action of the correction device. Port 42 may be useless if the leaks from valves 31 and 32 in closed position are appreciable.

It can be seen that the invention provides a correction of the richness of the air/fuel mixture supplied to the engine which is not only dependent on the amplitude of the alternating component of the depression in the intake pipe but also on the engine speed.

The invention obviously admits of numerous modified embodiments. In particular, the adjusting member may control a fuel passage section, as well as an air passage section or in place thereof. Corrector 16 may be of a different type from that which has been shown. The work chambers may be associated with distinct frequency filters.

We claim:

1. A carburettor for an internal combustion engine having an induction passage, a circuit for delivering a primary air/fuel mixture into said induction passage and a device for correcting the richness of the air/fuel mixture supplied by the carburettor in dependence of the amplitude of the alternating pressure component which prevails in operation in the induction passage, wherein said correction device has a member for metering a fuel or air flow cross-sectional area in said circuit and means for controlling said member in dependence of said alternating component, including a capillary tube and a capacity located in series flow relation from the induction passage to the member, constituting a frequency filter which transmits the depression which prevails in the induction passage with a dampening of the alternating component which increases with the frequency of that component.

2. A carburettor according to claim 1, wherein said member cooperates with a calibrated aperture for defining a passage for emulsion air located in parallel flow relation with a supplemental permanently open air inlet restrictor.

3. A carburettor according to claim 1, wherein the correction device comprises a main diaphragm separating two chambers and connected to said member for controlling the position thereof, said chambers being connected to said capacity by respective non return valves of low inertia whose opening directions are opposed.

4. A carburettor according to claim 3, wherein said chambers are connected by a restricted port.

5. A carburettor according to claim 3, wherein each of said chambers is limited by an auxiliary diaphragm subjected, on one face, to the atmospheric pressure and secured to said member, the effective areas of action of the pressures on the two auxiliary diaphragms being equal and being less than the effective area of action of the pressures on the main diaphragm.

6. A carburettor for internal combustion engine, having an induction passage, a circuit opening into said induction passage to deliver a primary air/fuel mixture into the induction passage, said circuit having fuel supply means, permanently open restricted air inlet, a second air inlet, a movable member projecting by a variable amount into said second air inlet for metering the effective flow cross-sectional area of said second air inlet, pressure responsive means for controlling the amount of projection of said member into said second inlet, and means for applying to said pressure responsive means a pressure differential which is in proportion to the alternating component of the depression which prevails in said intake passage with a damping which increases with the frequency of said alternating component.

* * * * *